United States Patent [19]

Vickland

[11] 4,251,819

[45] Feb. 17, 1981

[54] VARIABLE SUPPORT APPARATUS

[75] Inventor: Jack M. Vickland, Palo Alto, Calif.

[73] Assignee: Ford Aerospace & Communications Corp., Dearborn, Mich.

[21] Appl. No.: 927,208

[22] Filed: Jul. 24, 1978

[51] Int. Cl.[2] ..... H01Q 1/08

[52] U.S. Cl. ..... 343/882; 343/765; 343/912

[58] Field of Search ..... 343/765, 766, 881, 882, 343/880, 763, 757, 758, 912

[56] References Cited

U.S. PATENT DOCUMENTS

| | | | |
|---|---|---|---|
| 3,215,391 | 11/1965 | Storm | 343/765 |
| 3,374,977 | 3/1968 | Moy, Jr. | 343/765 |
| 3,546,704 | 12/1970 | Selby et al. | 343/765 |
| 3,665,482 | 5/1972 | Cresswell | 343/765 |
| 3,714,660 | 1/1973 | Scrafford et al. | 343/757 |
| 3,940,771 | 2/1976 | Wild | 343/766 |
| 3,945,015 | 3/1976 | Gueguen | 343/765 |
| 4,086,599 | 4/1978 | Vanderlinden, Jr. | 343/881 |

*Primary Examiner*—David K. Moore

*Attorney, Agent, or Firm*—Peter Abolins; Clifford L. Sadler

[57] ABSTRACT

This specification discloses an apparatus and method for supporting and moving an antenna load when tracking a satellite in a synchronous orbit. The apparatus includes three elongated supports all of which are attached to the antenna with couplings having a two degree of freedom of movement and two of which supports are attached to the ground with couplings having a two degree of freedom of movement. A stabilizing member coupled between the two supports having a two degree of movement connection with the ground rigidifies the support apparatus. Adjusting the longitudinal length of the elongated supporting members permits the antenna to be simply and effectively positioned over a wide angular range.

16 Claims, 8 Drawing Figures

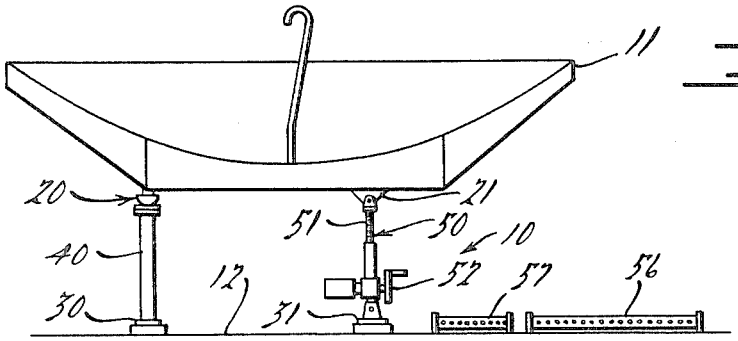
FIG. 4.
FIG. 5.
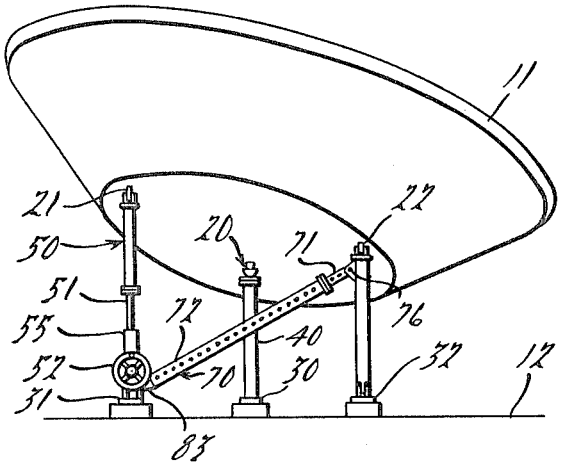
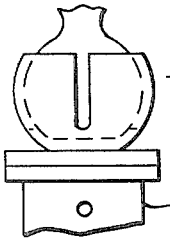
FIG. 6.
FIG. 7.
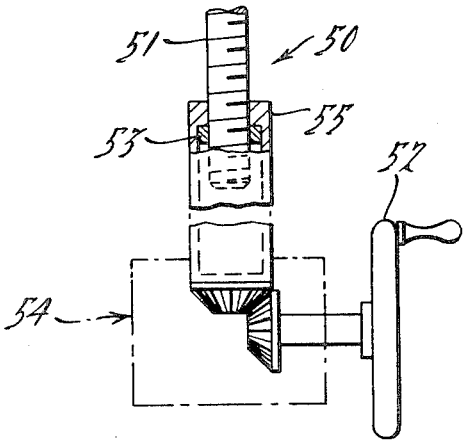
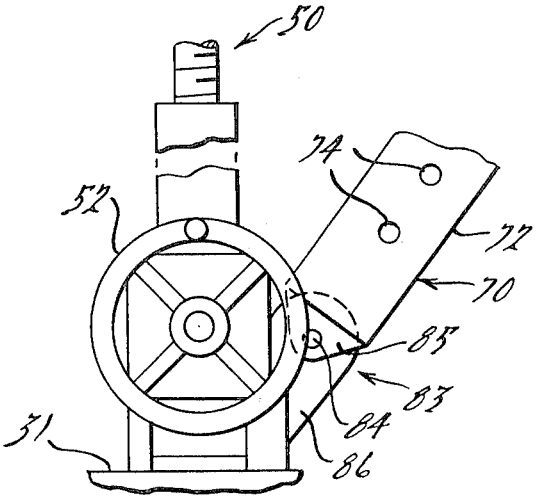
FIG. 8.

VARIABLE SUPPORT APPARATUS

1. Field of the Invention

This invention relates generally to positioning devices and, more particularly, to a suspension apparatus which permits angular positioning of an antenna load with respect to a supporting base.

2. Prior Art

There are known various variable support apparatus for use with an antenna of a satellite communication system. One of the requirements for a microwave feed and reflector in such a communication system is that the line of sight of the antenna must be infinately adjustable in any direction throughout relatively small angular ranges. Nevertheless, there must be a capability for grossly repositioning the mechanism so that the main position of the adjustable line of sight cone can be pointed anywhere in a geo-stationary satellite orbit, or, if desired, to the oribit of a different satellite.

Known positioning systems have used a rotating base mount for positioning in azimuth along with a yoke and further drive arrangement fixed to the rotating base to tilt the mounting plane in elevation. By this means the mounting plane or a device affixed thereto such as an antenna, may be oriented in azimuth and elevation with respect to a fixed base mount by providing rotational inputs to each of the two drives. These types of positioning systems in general tend to be bulky and necessitate the use of costly azimuth bearings when the device to be positioned is of considerable weight. Further, in known systems, the rotational inputs require expensive gearing to effect accurate positioning in each of the two planes.

Other known antennas for such satellite communication systems are driven by linear actuators whose line of action must be located at a reasonable distance from the antenna axis of rotation, providing a moment arm, through which the forces and moments imposed by wind and gravity are transferred from the antenna reflector to the base of the actuator. Thus a linear actuator system is limited in angular stroke which it can produce. As can be appreciated, imparting reciprocating angular motion to a crank, by means of linear actuator, is limited to crank angles of less than 180°, because when the crank arm is at top dead center, the actuator force line passes through the crank's center of rotation, thus the moment arm is zero and therefore the torque imparted to the crank is zero. A practical actuator can not provide much more than approximately 120° of angular motion.

Neither of the above two systems provide a satisfactory drive for antennas used in conjunction with a satellite communication system. Since linear actuators are limited in angular travel, the arrangement of the two axes with respect to each other, to the earth, and to the oribital plane of the communications satellite becomes a prime consideration. That is, the construction of the antenna is adapted to the particular latitude of the antenna site and the local hour angle to the mean satellite position. As a result, greater than minor adjustments of the antenna position are not easily done because of the repositioning of the antenna axes in order to provide satisfactory reception. There is still a need to provide a support apparatus for use with antennas to be used at satellite communication earth terminals wherein the antenna must be capable of two axes angular fine adjustment and gross repositioning to an entirely different sector of the synchronous orbit of another satellite system. These are some of the problems this invention overcomes.

SUMMARY OF THE INVENTION

This invention teaches a support apparatus and method for positioning a load, such as an antenna, wherein the load can be moved about a pair of axes whose relative position can be changed by adjustment of the support apparatus. The support apparatus permits both fine and gross adjustment. There is no bending moment applied to the connections between the support apparatus and the load thus facilitating construction and adjustment.

In accordance with the embodiment of this invention, a support adjustment apparatus for supporting and moving a load such as an antenna with respect to a base member, such as the ground, includes three suspension points coupled to the load, each of the three suspension points having two degrees of freedom of movement. Each of two of the suspension points associated with the load are coupled by base connecting means to a suspension point associated with the base member also having two degrees of freedom of movement. Longitudinal adjustment of the connecting means permits the load to be moved relative to two axes. In accordance with one embodiment of this invention, the two connecting means are joined by stabilizing means for stabilizing the four sided linkage formed by the two connecting means, the load and the base member. Further, one of the suspension points associated with the load is positioned at a distance from the edge of the load less than one-half the width of the load and the associated connecting means, which is attached to the stabilizing means has a length less than one-half the width of the load.

As a result of this construction, the invention provides a structure which is relatively simpler and less expensive than the known prior art and yet provides a greater range of angular coverage of the antenna load. Further, it is advantageous that the elongated connecting means connecting the load to the base have a longitudinal adjustment which permits both relatively small changes for minor adjustments and relatively gross repositioning capability to cover any visible satellite orbit. For example, fine adjustment can be achieved by a screw type connection between two telescoping members. Gross adjustment can be obtained by two telescoping members having holes therein which are aligned and secured to each other by a bolt. By spacing the holes in the two telescoping members at different intervals a vernier adjustment is possible. In a particular system, the adjustments available are the length of the connecting means, the relative position, both in bearing and distance of the suspension points coupled to the load with respect to each other and to the suspension points adjacent the base. With these adjustments, virtually every conceivable type of two axes antenna can be assembled without special parts peculiar to a particular site or location of the antenna. The support apparatus can be adapted to include such characteristics as wind profile, link lengths, actuator stroke length, cost and special user requirements.

BRIEF DESCRIPTION OF THE DRAWING

FIG. 4 is a view similar to FIG. 2 with the antenna positioned for movement about X and Y axes positioned advantageously for pointing at high elevation satellites;

FIG. 5 is an elevation view similar to FIG. 1 but with only one of the three connecting means longitudinally adjustable so that there is only a single axis about which the antenna can rotate;

FIG. 6 is an elevation view of a ball joint providing a two degrees of freedom of movement coupling to the antenna;

FIG. 7 is an elevation view of an elongated connecting means longitudinally adjustable by means of a screw; and FIG. 8 is a partial elevation view of a c connecting means and a stabilizing means coupled to the connecting means adjacent a suspension point having two degrees of freedom of movement.

DETAILED DESCRIPTION OF THE INVENTION

Figure 1:
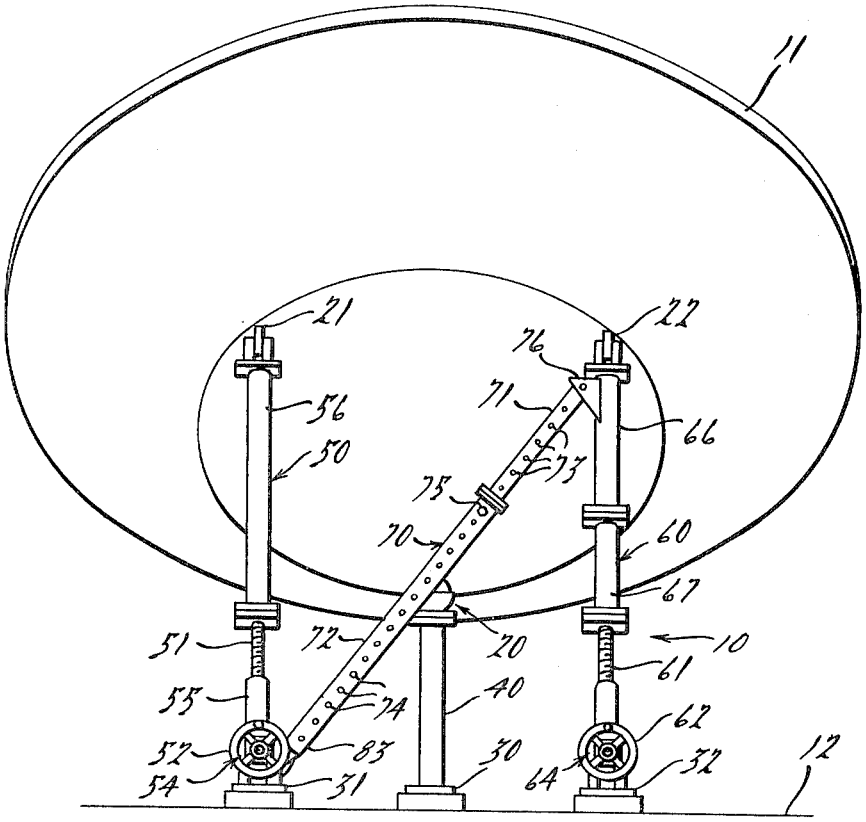
FIG. 1 is an elevation view of an antenna mounted on a support apparatus in accordance with an embodiment of this invention.
Figure 2:
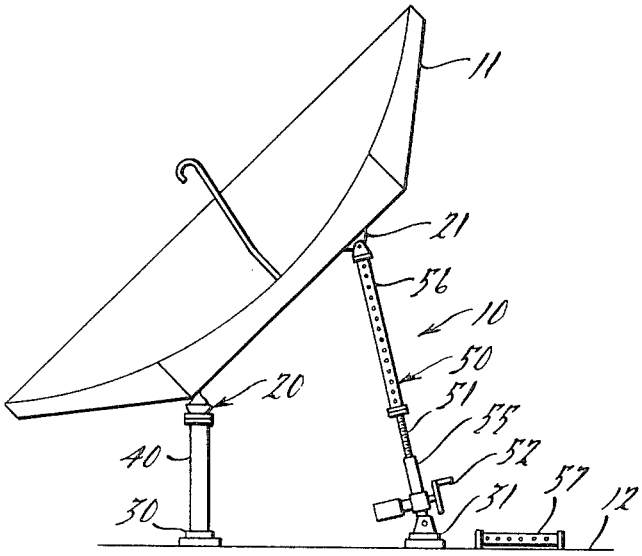
FIG. 2 is a side elevation view of the apparatus in FIG. 1.
Figure 3:
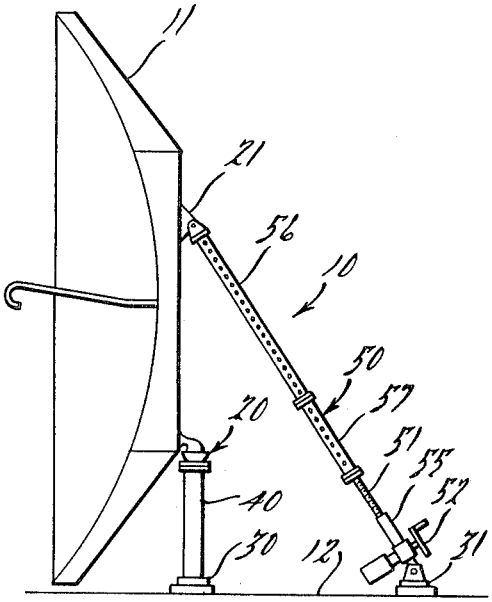
FIG. 3 is a view similar to FIG. 2 with the antenna and support apparatus positioned so the antenna can move about a vertical azimuth axis and a horizontal elevation axis.

Referring to FIG. 1, an antenna 11 is mounted on a support adjustment apparatus 10 so that antenna 11 can move relative to a ground surface 12. Support adjustment apparatus 10 includes suspension points 20, 21 and 22 which couple antenna 11 to variable length connecting rods 50 and 60 and to a fixed connecting rod or pylon 40. Connecting rods 50 and 60 are connected to ground surface 12 at suspension points 31 and 32 respectively. A stabilizing bar 70 extends from a portion of connecting rod 60 adjacent suspension point 22 to a portion of connecting rod 50 adjacent suspension point 31. As a result, by changing the length of c connecting rods 50 and 60, and, if necessary, stabilizing bar 70, antenna 11 can be rotated as desired about an axis defined by suspension point 20 and suspension point 31 and an axis defined by suspension point 20 and suspension point 22. This relatively simple and light weight system permits a variety of angular movements of antenna 11. In particular, FIG. 3 shows where the axis between suspension point 20 and suspension point 22 is an azimuth axis. FIG. 4 shows antenna 11 positioned for movement following a high altitude satellite and FIG. 5 shows an embodiment of this invention wherein only one of the connecting rods is adjustable and therefore movement of antenna 11 is about a single axis defined by suspension points 20 and 22.

Suspension point 20 is made by a single ball joint, a universal joint, or a self aligning ball bushing capable of restraining forces from all directions but permitting rotation in any direction (FIG. 6). The pylon 40 is of a fixed length and a suspension point 30 connecting pylon 40 to ground surface 12 is also fixed. Thus, suspension point 30 and connecting rod or pylon 40 establish a fixed location for suspension point 20 about which antenna 11 can move. Spaced from suspension point 20 are suspension points 21 and 22 which are similar to suspension point 20 in that they permit two degrees of freedom of movement. The same is also true for suspension points 31 and 32, connecting rods 50 and 60 respectively, to ground surface 12. If suspension point 20 is directly connected to the ground then the pylon 40 shown in FIG. 6 is eliminated and ground surface 12 is adjacent suspension point 20.

Connecting rods 50 and 60 are similar to each other and different from connecting rod 40 in that they are longitudinally adjustable. Specifically, each connecting rod 50 and 60 includes a screw 51 and 61, respectively, which is actuated by a motor or handle 52 and 62, respectively. Rotation of screw 51 (or 61) is done by a handle 52 (or 62) coupled to screw 51 (or 61) by a gear 54 (or 64) (such as a bevel gear shown in FIG. 7). Connecting rod 50 includes a hollow cylindrical member 55 which receives therein screw 51 and is fixedly attached to thrust nut 53. Connecting rod 60 has an analogous member 65 and nut 63 (not shown). As a result, arbitrarily small changes in the length of connecting rods 50 and 60 can be accomplished using screws 51 and 61. Discrete changes in the length of connecting rods 50 and 60, such as are particularly well suited for gross adjustments, are accomplished by relative movement between two telescoping portions 56 and 57 within connecting rod 50 (FIG. 3) and telescoping portions 66 and 67 within connecting rod 60 (FIG. 1). Along the length of each of member 56, 57, 66 and 67 are spaced openings which can be aligned with each other within a given cylindrical member and a bolt passed through the openings to rigidly secure the length of the connecting rod. The size of the discreet adjustments in the length of connecting rod 50 and 60 can be made small, if desired, by using the vernier principle in locating bolt holes in the two telescoping portions 56 and 57 (or 66 and 67). For example, a specific length of one of the telescoping portions can be drilled with 20 equally spaced holes, and the same length in the associated telescoping member can be drilled with 21 equally spaced holes, providing 420 equally spaced discrete lengths of the cylindrical member and therefore of connecting rod.

Additional variation in the length of connecting rod 50 and 60 can be accomplished by using additional telescoping portions. For example, each cylindrical member 55 (or 65) can be comprised of a plurality of members, the first member being equal to half the total length variation required, and each subsequent member equal to half the previous member, so that a large length adjustment range is achievable in relative small discrete increments, with the use of a small quantity of different parts. As an example, if a strut is desired having a length adjustment range of 128 inches and discrete adjustment increments of 1 inch, then the strut lengths required are 64 inches, 32 inches, 16 inches, 4 inches, 2 inches, and 1 inch, a total of only 7 pieces. More generally, the number of different lengths required can be computed using the mathematical formula $$N = > \frac{\text{Log } A/D}{\text{Log } 2}$$

Where A is the total length variation required as computed by the difference between the maximum length and a minimum length required; D is equal to the maximum discrete adjustment increments required; and N is equal to the number of different lengths required, which must be an integral number.

Stabilizing bar 70 is also longitudinally adjustable in a way cylindrical members 55 and 65 are adjustable. However, in the embodiment described, a fine adjustment screw and handle is omitted and only a discrete adjustment using telescoping members is used. Stabilizing bar 70 includes an inside cylindrical member 71 and an outside cylindrical member 72 which telescope within one another. Inside member 71 has longitudinally arranged equally spaced inside holes 73 and outside member 72 has outside holes 74 also longitudinal spaced. A bolt 75 passes through aligned inside holes 73 and outside holes 74 to secure the length of stabilizing bar 70. Stabilizing bar 70 includes an upper pivot connection 76 connecting stabilizing bar 72, the upper portion of connecting bar 60 adjacent antenna 11 and a lower pivot connection 83 connecting the lower portion of stabilizing bar 70 adjacent a portion of connecting rod 50 adjacent ground surface 12.

Referring to FIG. 8, lower pivot connection 83 includes a lower pivot flange 85, extending from outside member 72, which receives a lower pivot pin 84 and connects a lower pivot plate 86, extending outwardly from the bottom portion of connecting rod 50, to lower pivot flange 85. Similarly, although not shown, upper pivot connection 76 is fixedly connected to stabilizing bar 70 and includes an upper pivot flange 78, extending from inside member 71, for receiving an upper pivot pin 77 thereby connecting an upper pivot plate 79, extending from connecting rod 60, to upper pivot flange 78.

Suspension point 20 is positioned adjacent one edge of antenna 11 so that pylon 40 can be shorter than one-half the diameter of antenna 11 and still permit antenna 11 to be aimed substantially perpendicular to pylon 40. If antenna 11 has a parabolic shape, suspension point 20 is located off the axis of symmetry or the parabolic axis. Keeping pylon 40 as short as possible is desirable because it must sustain bending loads in addition to axial loads. In contrast, connecting rods 50 and 60 need sustain axial loads and not bending loads. Thus, the length of connecting rods 50 and 60 is not as critical as the length of pylon 40 for having a simple, sturdy and low cost structure.

OPERATION

Antenna 11 can be adjusted over a wide range of angular positions by selectively and appropriately operating support apparatus 10. More specifically, varying the length of connecting rod 60 will cause rotation of antenna 11 about an axis extending through suspension point 20 and suspension point 31. Analogously, variation of the length of connecting rod 50 will cause rotation of antenna 11 about a rotational axis extending through suspension point 20 and suspension point 22. These two rotational axes are independent of one another. As a result, the angular range of antenna 11 is not limited to 180° but only by the particular construction of the suspension points and the connecting rods.

Support apparatus 10 can provide various gross angular adjustments which then provide a basis for fine adjustment. For example, FIG. 4 shows an X-Y configuration for pointing at high elevation satellites. FIG. 3 depicts a mount, which approximates an azimuth elevation mount, wherein azimuth adjustments are achieved by simultaneously actuating connecting rods 50 and 60 in opposite directions and elevation adjustment is achieved by simultaneously actuating connecting rods 50 and 60 in the same direction. The need for rotation about two independent axes of rotation in conjunction with a geostationary satellite orbit can be reduced by orienting one of the two rotational axes orthogonally to a plane defined by the position of antenna 11 and two points in the geostationary satellite orbit. Such an orientation mimimizes the maximum declination pointing error over a portion of the satellite orbital arc thus reducing the need for the other of the two rotational axes.

Stabilizing bar 70 performs the function of stabilizing the four sided linkage formed by ground surface 12, antenna 11 and connecting rods 50 and 60, and can be readjusted when connecting rods 50 and 60 are grossly adjusted in length.

Various modifications and variations will no doubt occur to those skilled in the art to which this invention pertains. For example, the relative positions of suspension points on the antenna and on the ground may be changed from that disclosed herein. Similarly, the length of the fixed rod and the cross sectioned shape of the connecting rods may be varied from that disclosed herein. These and all variations which basically come within the scope of the appended claims, are considered to be part of this invention.

I claim:

1. A support adjustment apparatus for supporting and moving an antenna load with respect to a base member, said antenna load being symmetric and having a fixed point of rotation off the axis of symmetry of said antenna load, said support adjustment apparatus comprising:

a first suspension point, a second suspension point and a third suspension point associated with the load for permitting movement of the load with respect to said support adjustment apparatus, said first, second and third suspension points permitting rotation about two axes so that the load has two degrees of freedom of movement with respect to each of said suspension points;

a fourth suspension point, a fifth suspension point and a sixth suspension point associated with the base member so that there is no relative movement of the base member with respect to said fourth suspension point, and said fifth and sixth suspension points permitting two degrees of freedom of movement with respect to the base member;

a first connecting means for connecting said first and fourth suspension points;

a second connecting means for connecting said second and fifth suspension points;

a fourth connecting means for connecting said third and fifth suspension points so that the load can move relative to the base member about two axes, a first axis being defined by said first and fifth suspension points and a second axis being defined by said first and third suspension points, and said first suspension point being positioned at a distance from the edge of the load less than one half the width of the load and said first connecting means having a length less than one half the width of said load thereby providing that the bending load applied to said support adjustment apparatus is applied to a member having a length less than one-half the width of said load and permitting said axis of symmetry to achieve both a horizontal and a vertical orientation with respect to the base member.

2. A support adjustment apparatus as recited in claim 1 wherein said second, third and fourth connecting means are elongated and longitudinally adjustable.

3. A support adjustment apparatus as recited in claim 2 wherein said second and third connecting means each include a gross longitudinal adjustment means for adjusting longitudinal length in discrete increments and a fine longitudinal adjustment means for adjusting longitudinal length by increments smaller than said discrete increments.

4. A support adjustment apparatus as recited in claim 3 wherein said gross longitudinal adjustment means includes at least two telescoping elongated members with longitudinally spaced holes for receiving a support pin when two holes of at least two members are aligned; and said fine longitudinal adjustment means includes a relatively rotatable screw means for adjusting the length of each of said second and third connecting means.

5. A support adjustment apparatus as recited in claim 1 wherein said first and fourth suspension points are coincident so that the load is coupled directly to the base member with two degrees of freedom of movement.

6. A support adjustment apparatus for supporting and moving a load, such as, for example, an antenna with respect to a base member, said load being symmetric and having a fixed point of rotation off the axis of symmetry of said load, said support adjustment apparatus comprising:

three spaced connecting means for connecting the load to the base member, the connections between the load and each a first, a second and a third connecting means of said three spaced connecting means providing two degrees of freedom of movement, the connections between the base member and each of said second and said third connecting means of said three connecting means providing two degrees of freedom;

a stabilizing means connecting said second and said third connecting means to stabilize the four sided linkage formed by said second connecting means, said third connecting means, the base member and the load; and said first connecting means being connected to the load at a location less than one-half the width of the load from the edge of the load and having a length less than one-half the width of the load and permitting said axis of symmetry to achieve both a horizontal and a vertical orientation with respect to the base member.

7. A support adjustment apparatus as recited in claim 6 wherein said second and third connecting means are longitudinally adjustable thereby permitting movement of the load so that a bending movement is applied to neither said second connecting means nor said third connecting means thereby reducing the structural strength required in said second and third connecting means in comparison to when a bending moment is applied.

8. A support adjustment apparatus as recited in claim 7 wherein said stabilizing means is connected between an end of said second connecting means adjacent the base member and an end of said third connecting means adjacent the load, said stabilizing means being longitudinally adjustable.

9. A support adjustment apparatus as recited in claim 8 wherein said first connecting means is rigidly connected to the base member so that the load has two rotational axes, a first rotational axis being defined by the connection between the load and said first connecting means and the connection between said connecting means and the base member, and a second rotational axis being defined by the connection the load and said third connecting means.

10. A support adjustment apparatus as recited in claim 9 wherein said stabilizing means has pivotal connection to said second and third connecting means so that longitudinal adjustment of said second connecting means, said third connecting means, and said stabilizing means can cause movement of the load about said first and second rotational axes, said second and third connecting means being relatively positioned so that said first and second rotational axes are independent.

11. A support adjustment apparatus as recited in claim 10 wherein said second and third connecting means each includes linear screw actuators for fine longitudinal adjustment and a pair of telescoping members with spaced bolt holes along their length, the spacing on one member being different from the spacing on the other, thus providing a vernier adjustment in discrete steps in addition to the fine adjustment so that a first adjustment of position of said first and second rotational axes is provided by changing the length of said second and third connecting means by increments of opposite sign and so that a second adjustment to said first and second rotational axes is provided by changing the length of said second and third connecting means by increments of the same sign.

12. A support adjustment apparatus as recited in claim 11 wherein one of said first and second rotational axes is oriented orthogonally to a plane defined by the position of the load, and two points in a geo-stationary satellite orbit thus minimizing the maximum declination pointing error over a portion of said first and second rotational axes.

13. A support adjustment apparatus as recited in claim 11 wherein at least one of said second and third connecting means comprises a plurality of separate members, a first member being equal to half the total length variation required and each subsequent member having a length equal to half the previous length so that a relatively large length adjustment range is achievable in relatively small discrete increments with the use of a relatively small quantity of different parts, the number of members being determined by the equation $$N = > \frac{\text{Log } A/D}{\text{Log } 2}$$

where A = the adjustment range as determined by the difference between the maximum and minimum lengths required of the connecting means, D = maximum discrete adjustment increments desired, N = the number of different members required, wherein N is an integral number.

14. A method of supporting and moving a symmetric load having an axis of symmetry, such as, for example, an antenna, wherein three spaced, connecting members are connected between the load and a base member, two of said members are connected by a stabilizing member, said method including the steps of:

connecting the three connecting members to the load so as to allow two degrees of freedom of movement;

connecting a first of the three connecting members to the load at a location less then one-half the width of the load from the edge of the load;

connecting two of the three connecting members to the base so as to allow two degrees of freedom of movement;

adjusting the length of a second of the connecting members so that the load moves about a first axis of rotation;

adjusting the position of the load about a fixed point of rotation off the axis of symmetry of the load so that the bending moment applied by the load to the three connecting members is substantially all applied to the first connecting member and the axis of symmetry can achieve both a horizontal and a vertical orientation with respect to the base member.

15. A method of supporting and moving a load as recited in claim 14 wherein the step of ad adjusting the length of one of the connecting members includes the steps of:

turning a screw adjustment between two telescoping members for fine adjustment of the length of the connecting member;

positioning two telescoping members so that a hole in one member is aligned with a hole in another member; and securing a bolt through two aligned holes in the telescoping members.

16. A method of supporting and movnig a load as recited in claim 13 further including the step of adjusting the length of the stabilizing member in conjunction with adjustment of the length of the c connecting members.

* * * * *

UNITED STATES PATENT AND TRADEMARK OFFICE

CERTIFICATE OF CORRECTION

PATENT NO. : 4,251,819

DATED : February 17, 1981

INVENTOR(S) : Jack M. Vickland

It is certified that error appears in the above-identified patent and that said Letters Patent are hereby corrected as shown below:

Column 6, between lines 43 and 44, insert --a third connecting means for connecting said third and sixth suspension points;--

Signed and Sealed this

*Twenty-fourth* Day of *November 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,251,819

DATED : February 17, 1981

INVENTOR(S) : Jack M. Vickland

It is certified that error appears in the above-identified patent and that said Letters Patent are hereby corrected as shown below:

Column 3, line 20, please delete the letter "c";
line 39, please delete the letter "c".

Column 7, line 48, delete "movement" and insert therefore --moment--;
line 65, after "between said" insert --second--;
line 67, after "connection" insert --between the load and said first connecting means and the connection between--.

Column 8, line 58, delete "are" and insert therefore --being--;
line 64, delete "then" and insert therefore --than--.

Column 9, line 15, delete "ad", (first occurrence).

Column 10, line 10, delete "movning" and insert therefore --moving--;
line 11, delete "13" and insert therefore --14--;
line 13, delete "c" (first occurrence).

Signed and Sealed this

*Thirty-first* Day of *August 1982*

[SEAL]

*Attest:*

GERALD J. MOSSINGHOFF

*Attesting Officer*

*Commissioner of Patents and Trademarks*